US009309788B2

(12) United States Patent
Nair et al.

(10) Patent No.: US 9,309,788 B2
(45) Date of Patent: Apr. 12, 2016

(54) VALVE BRIDGE ASSEMBLY HAVING REPLACEABLE SLEEVE INSERTS

(71) Applicant: Electro-Motive Diesel, Inc., Lagrange, IL (US)

(72) Inventors: Adarsh Gopinatahn Nair, Darien, IL (US); Laura Elise Rasmussen, III, Burr Ridge, IL (US); Vijaya Kumar, Darien, IL (US); Patricia Anne McWade, Willowbrook, IL (US)

(73) Assignee: Electro-Motive Diesel, Inc., LaGrange, IL (US)

( * ) Notice: Subject to any disclaimer, the term of this patent is extended or adjusted under 35 U.S.C. 154(b) by 133 days.

(21) Appl. No.: 13/946,439

(22) Filed: Jul. 19, 2013

(65) Prior Publication Data

US 2015/0021508 A1 Jan. 22, 2015

(51) Int. Cl.

| | |
|---|---|
| ***F01L 1/18*** | (2006.01) |
| ***F01L 1/26*** | (2006.01) |
| ***F01L 1/24*** | (2006.01) |
| *F01L 1/14* | (2006.01) |
| *F01L 1/047* | (2006.01) |

(52) U.S. Cl.

CPC ..... *F01L 1/26* (2013.01); *F01L 1/2411* (2013.01); *F01L 1/146* (2013.01); *F01L 1/181* (2013.01); *F01L 2001/054* (2013.01); *F01L 2105/00* (2013.01); *F01L 2810/02* (2013.01); *Y10T 137/0486* (2015.04)

(58) Field of Classification Search

CPC ..... F02M 63/0078; F02M 63/00
USPC ..... 123/90.39, 90.22
See application file for complete search history.

(56) References Cited

U.S. PATENT DOCUMENTS

| | | | | |
|---|---|---|---|---|
| 4,924,821 | A | 5/1990 | Teerman | |
| 7,921,818 | B2 | 4/2011 | Rauch et al. | |
| 8,091,522 | B2 | 1/2012 | Minato et al. | |
| 8,210,144 | B2 | 7/2012 | Langewisch | |
| 2005/0211206 | A1* | 9/2005 | Ruggiero et al. | 123/90.16 |
| 2006/0000432 | A1 | 1/2006 | Yamamoto et al. | |
| 2012/0024146 | A1 | 2/2012 | Saito | |
| 2012/0132162 | A1 | 5/2012 | Yoon et al. | |

FOREIGN PATENT DOCUMENTS

| | | |
|---|---|---|
| DE | 102008036874 | 2/2010 |

* cited by examiner

*Primary Examiner* — Zelalem Eshete

(57) ABSTRACT

A valve bridge assembly is disclosed for use with an internal combustion engine. The valve bridge assembly may have a valve bridge with a center portion, opposing lateral extensions, a central cavity formed within the center portion, and a bore formed within each of the opposing lateral extensions. The valve bridge assembly may also have a lash adjuster disposed within the central cavity, and a sleeve insert disposed within each bore of the opposing lateral extensions. Each sleeve insert may be configured to receive a corresponding valve stem.

13 Claims, 3 Drawing Sheets

VALVE BRIDGE ASSEMBLY HAVING REPLACEABLE SLEEVE INSERTS

TECHNICAL FIELD

The present disclosure is directed to a valve bridge assembly and, more particularly, to a valve bridge assembly having replaceable sleeve inserts.

BACKGROUND

Each cylinder of an internal combustion engine is equipped with one or more gas exchange valves (e.g., intake and exhaust valves) that are cyclically opened during normal operation. In a conventional engine, the valves are opened by way of a camshaft/rocker arm configuration. The camshaft includes one or more lobes arranged at particular angles corresponding to desired lift timings and amounts of the associated valves. The cam lobes are connected to stem ends of the associated valves by way of the rocker arm and associated linkage components. As the camshaft rotates, the cam lobes come into contact with a first pivoting end of the rocker arm, thereby forcing a second pivoting end of the rocker arm against the stem ends of the valves. This pivoting motion causes the valves to lift or open against a spring bias. As the cam lobes rotate away from the rocker arm, the valves are released and allowed to return to their closed positions.

When a cylinder is equipped with more than one of the same type of gas exchange valve (e.g., more than one intake valve and/or more than one exhaust valves), all valves of the same type are typically opened at about the same time. And in order to reduce a number of camshafts, cam lobes, and/or rocker arms required to open the multiple valves, a valve bridge is often used to interconnect the same type of valves with a common rocker arm.

A valve bridge is generally T-shaped, having arms that extend between the stem ends of two like valves. The second end of the rocker arm engages a center portion of the valve bridge, between the arms. With this configuration, a single pivoting motion imparted to the center of the valve bridge by the rocker arm results in lifting of the paired valves by about the same amount and at about the same timing. A lash adjuster can be associated with the valve bridge and used to remove clearance that exists between the valves and corresponding seats (and/or between other valve train components) when the valve is released by the rocker arm. The lash adjuster helps to ensure sealing of the cylinder during the ensuing combustion process.

An exemplary valve bridge is disclosed in U.S. Pat. No. 8,210,144 that issued to Langewisch on Jul. 3, 2012 ("the '144 patent"). Specifically, the '144 patent discloses a T-shaped valve bridge having a center portion and lateral extensions located at opposing sides of the center portion. A bridge cavity is formed within the center portion to receive a lash adjuster, and bores are formed within the lateral extensions to receive stem ends of associated engine valves. The lash adjuster includes a plunger assembled within the bridge cavity to form a hydraulic chamber. The plunger is configured to engage a button member located at an end of a rocker arm and is hydraulically connected to the rocker arm via the button member. A check valve is disposed within the plunger and separates a reservoir chamber from the hydraulic chamber. As pressure within the hydraulic chamber increases, the check valve cuts off fluid communication between the two chambers. As pressure within the hydraulic chamber drops below a pressure of the reservoir chamber, the check valve moves to allow fluid from the reservoir chamber into the hydraulic chamber. A spring is disposed within the hydraulic chamber and configured to bias the plunger out of the bridge cavity.

Although the valve bridge of the '144 patent may be suitable for many applications, it may still be less than optimal. For example, because the valve bridge directly engages the stem ends of the associated valves and the plunger of the lash adjuster, the valve bridge may wear and need to be replaced after a period of operation. This replacement can be expensive in some situations.

The valve bridge of the present disclosure is directed towards overcoming one or more of the problems set forth above and/or other problems of the prior art.

SUMMARY

One aspect of the present disclosure is directed to a sleeve insert for a valve bridge assembly. The sleeve insert may include a generally cylindrical body having an outer surface configured to be press-fitted into a corresponding bore in a valve bridge. The sleeve insert may also include a central bore formed in the generally cylindrical body and configured to receive a stem-end of a gas exchange valve. The sleeve insert may further include a lubrication passage configured to connect a reservoir of the valve bridge with an end of the central bore.

Another aspect of the present disclosure is directed to a valve bridge assembly. The valve bridge assembly may include a valve bridge with a center portion, opposing lateral extensions, a central cavity formed within the center portion, and a bore formed within each of the opposing lateral extensions. The valve bridge assembly may also include a lash adjuster disposed within the central cavity, and a sleeve insert disposed within each bore of the opposing lateral extensions. Each sleeve insert may be configured to receive a corresponding valve stem.

In yet another aspect, the present disclosure is directed to a method of remanufacturing a valve bridge assembly. The method may include inserting a removal tool through bores located within lateral extensions of a valve bridge to push worn sleeve inserts out of the bores. The method may further include press-fitting replacement sleeve inserts into the bores.

DETAILED DESCRIPTION

Figure 1:
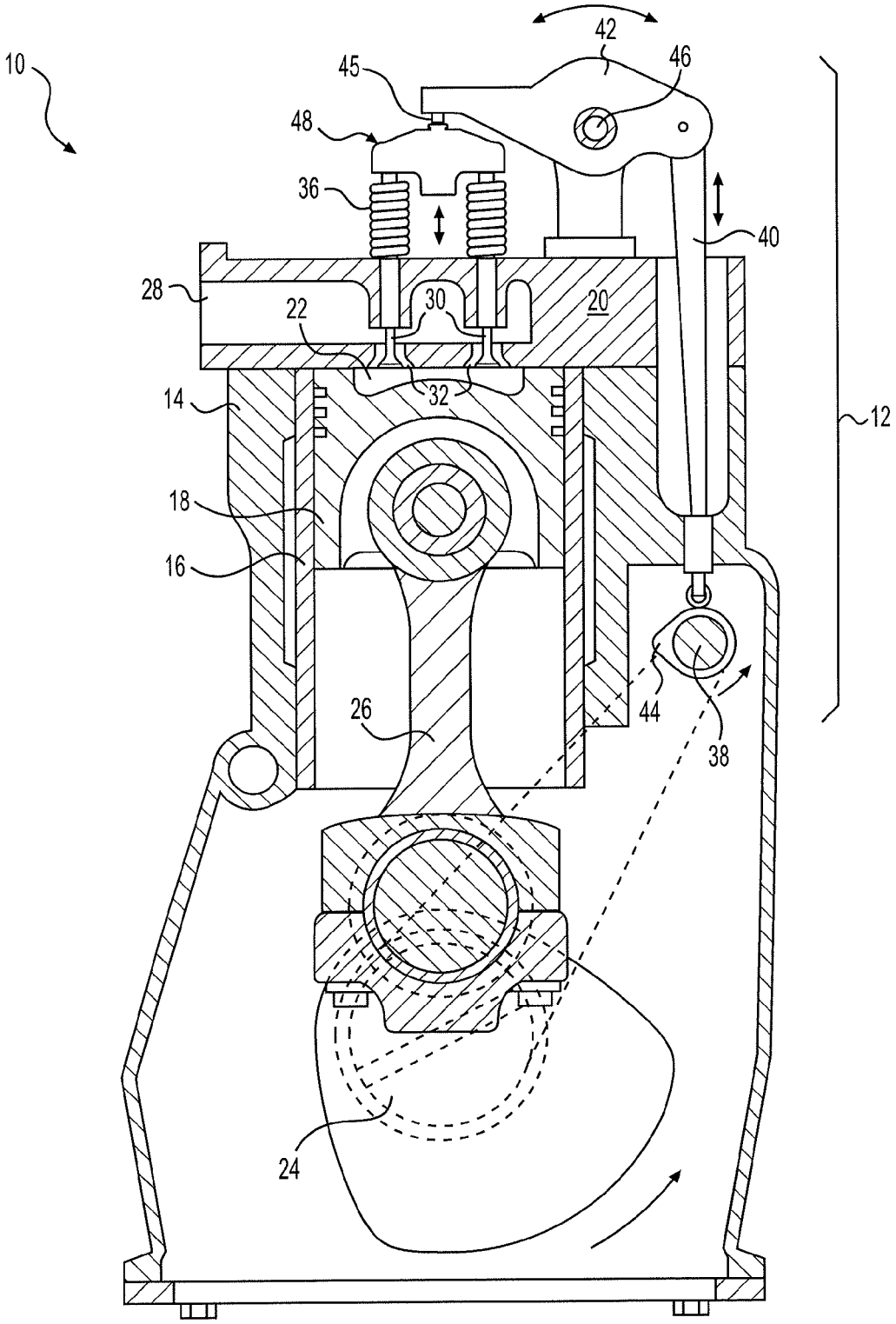
FIG. 1 is a diagrammatic illustration of an exemplary disclosed engine valve actuation system.

FIG. 1 illustrates an engine equipped with an exemplary disclosed valve actuation system 12. For the purposes of this disclosure, engine 10 is depicted and described as a four-stroke diesel engine. One skilled in the art will recognize, however, that engine 10 may embody any type of combustion engine such as, for example, a two- or four-stroke, gasoline or a gaseous fuel-powered engine. As will be described in more detail below, valve actuation system 12 may help regulate fluid flows through engine 10.

Engine 10 may include an engine block 14 that at least partially defines one or more cylinders 16. A piston 18 and a cylinder head 20 may be associated with each cylinder 16 to form a combustion chamber 22. Specifically, piston 18 may be slidably disposed within each cylinder 16 to reciprocate between a top-dead-center (TDC) position and a bottom-dead-center (BDC) position, and cylinder head 20 may be positioned to cap off an end of cylinder 16, thereby forming combustion chamber 22. Engine 10 may include any number of combustion chambers 22 and combustion chambers 22 may be disposed in an "in-line" configuration, in a "V" configuration, in an opposing-piston configuration, or in any other suitable configuration.

Engine 10 may also include a crankshaft 24 rotatably disposed within engine block 14. A connecting rod 26 may connect each piston 18 to crankshaft 24 so that a sliding motion of piston 18 between the TDC and BDC positions within each respective cylinder 16 results in a rotation of crankshaft 24. Similarly, a rotation of crankshaft 24 may result in a sliding motion of piston 18 between the TDC and BDC positions. In a four-stroke engine, piston 18 may reciprocate between the TDC and BCD positions through an intake stroke, compression stroke, a power stroke, and an exhaust stroke. In a two-stroke engine, piston 18 may reciprocate between the TDC and BCD positions through a power/exhaust/intake stroke and an intake/compression stroke.

Cylinder head 20 may define one or more fluid passages 28 associated with each combustion chamber 22 that are configured to direct gas (e.g., air and/or exhaust) or a mixture of gas and fluid (e.g., fuel) into or out of the associated chamber 22. In the disclosed embodiment, cylinder head 20 is shown as defining a single passage 28. Passage 28 may represent either an intake passage or an exhaust passage in this embodiment. It should be noted that, while only a single fluid passage 28 is shown, as many intake and/or exhaust passages may be provided within cylinder head 20 as desired. As an intake passage, passage 28 would be configured to deliver compressed air and/or an air and fuel mixture into a top end of combustion chamber 22. As an exhaust passage, passage 28 would be configured to direct exhaust and residual gases from the top end of combustion chamber 22 to the atmosphere. It is contemplated that, in some embodiments, only an exhaust passage may be formed within cylinder head 20 and the corresponding intake passage may instead be formed within engine block 14. In these configurations, the intake passage would be configured to direct air and/or the mixture of air and fuel radially inward to combustion chamber 22 through a side wall of cylinder 16.

A plurality of gas exchange valves 30 may be disposed within openings of passageway 28 and movable to selectively engage corresponding seats 32. Specifically, each valve 30 may be movable between a first position at which valve 30 is engaged with seat 32 to inhibit a flow of fluid through the opening, and a second position at which valve 30 is moved away from seat 32 (i.e., lifted) to allow a flow of fluid through the opening. The timing at which valve 30 is moved away from seat 32 (relative to a position of piston 18 between the TDC and BDC positions), as well as a lift height of valve 30 at the particular timing, may have an effect on the operation of engine 10. For example, the timing and lift height may affect production of emissions, production of power, fuel consumption, efficiency, temperature, pressure, etc. A spring 36 may be associated with each valve 30 and configured to bias valve 30 toward the first position and against seat 32.

Valve actuation system 12 may be operatively engaged with cylinder head 20 and configured to simultaneously move valves 30 against the biases of springs 36 from their first positions toward their second positions at desired timings. It should be noted that, when each cylinder head 20 is provided within both intake and exhaust passages and corresponding intake and exhaust valves, engine 10 may include a separate valve actuation assembly for each set of intake and exhaust valves. Each valve actuation system 12 may include, among other things, a common camshaft 38, a dedicated cam follower arrangement (e.g., cam followers, push rods, etc.) 40, and a dedicated rocker arm 42.

Camshaft 38 may operatively engage crankshaft 24 in any manner readily apparent to one skilled in the art, where a rotation of crankshaft 24 results in a corresponding rotation of camshaft 38. For example, camshaft 38 may connect to crankshaft 24 through a gear train (not shown) that decreases the rotational speed of camshaft 38 to approximately one half of the rotational speed of crankshaft 24 (in the exemplary 4-stroke arrangement). Alternatively, camshaft 38 may connect to crankshaft 24 through a chain, a belt, or in any other appropriate manner. At least one cam lobe 44 may be connected to camshaft 38 and associated with each pairing of valves 30. An outer profile of cam lobe 44 may determine, at least in part, the actuation timing and lift profile of valves 30 during operation of engine 10.

Cam follower arrangement 40 may ride on and move in accordance with the profile of cam lobe 44 as camshaft 38 rotates, and transfer a corresponding reciprocating motion to a first pivoting end of rocker arm 42. This reciprocating motion imparted to rocker arm 42 may cause rocker arm 42 to pivot about a pivot point 46, thereby creating a corresponding reciprocating motion at an opposing second end of rocker arm 42 that lifts and releases valves 30. Thus, the rotation of camshaft 38 may cause valves 30 to move from the first position to the second position to create a specific lift pattern corresponding to the profile of cam lobe 44.

Rocker arm 42 may be connected to valves 30 by way of a valve bridge assembly 48. Specifically, rocker arm 42 may include a pin or button 45 that is received within a bore (not shown) at the second end of rocker arm 42. Button 45 may be able to swivel somewhat within the bore of rocker arm 42, and include a generally flat end surface that is configured to slide along a corresponding planar portion of valve bridge assembly 48. The ability of button 45 to swivel and slide along the planar portion of valve bridge assembly 48 may allow rocker arm 42 to transmit primarily vertical (i.e., axial) forces into valve bridge assembly 48. The only horizontal (i.e., transverse) forces transmitted between rocker arm 42 and valve bridge assembly 48 may be relatively low and due only to friction at the sliding interface between button 45 and bridge assembly 48. This interface may be lubricated and/or polished to reduce the associated friction.

Figure 2:
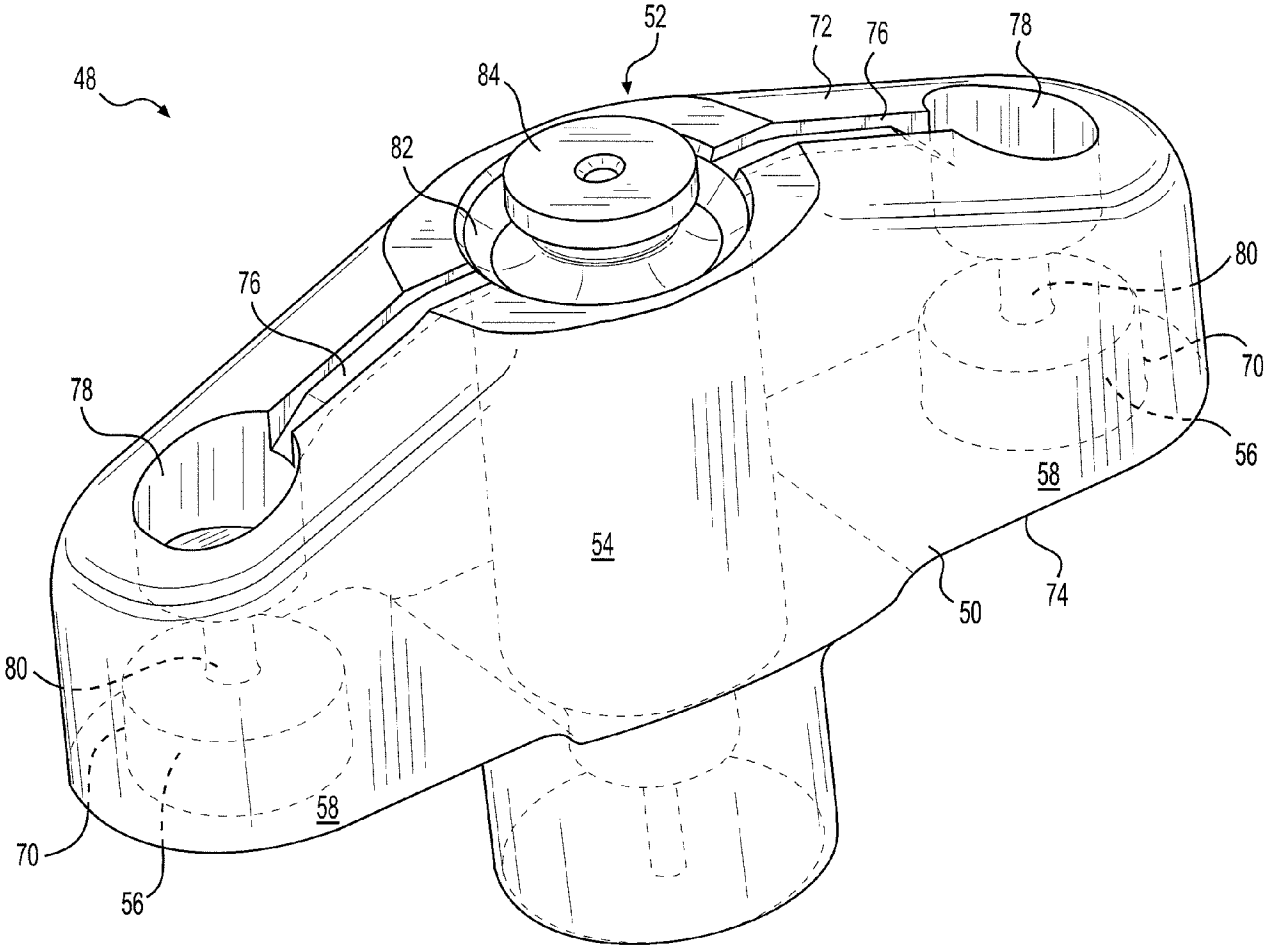
FIG. 2 is a transparent isometric illustration of an exemplary disclosed valve bridge assembly that may be used in conjunction with the engine valve actuation system of FIG. 1.
Figure 3:
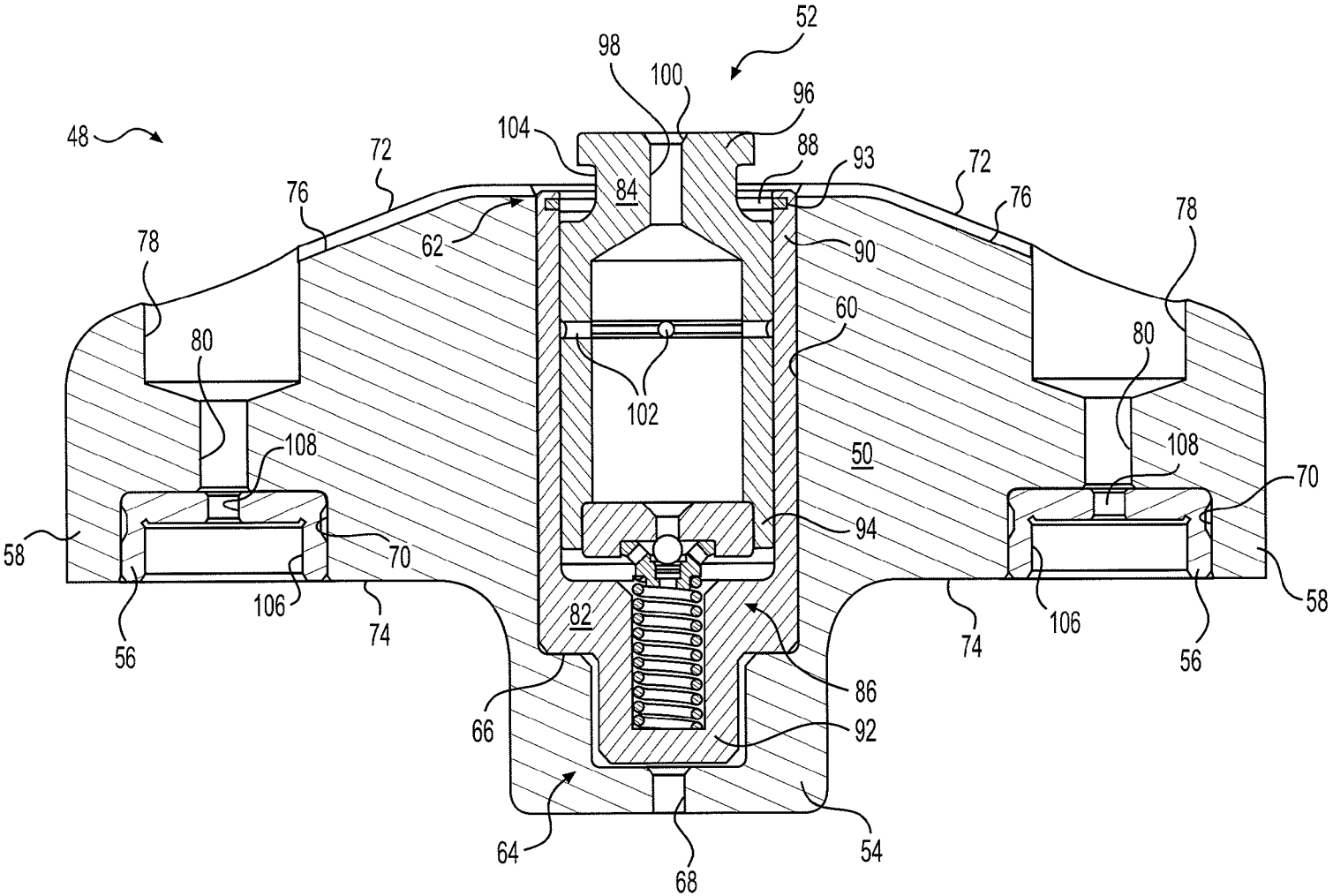
FIG. 3 is a cross-sectional illustration of the valve bridge assembly of FIG. 2.

An exemplary valve bridge assembly 48 is shown in FIGS. 2 and 3. As can be seen in these figures, valve bridge assembly 48 may include, among other things, a valve bridge 50, a lash adjuster 52 removably disposed with a central portion 54 of valve bridge 50, and sleeve inserts 56 removably disposed within opposing lateral extensions 58 of valve bridge 50. As will be described in more detail below, lash adjuster 52 may be configured to adjust a clearance between valves 30 and seats 32 (and/or between other valve train components) when cam lobe 44 is rotated away from cam follower 40, while sleeve inserts 56 may be configured to receive stem ends of valves 30.

Valve bridge 50 may be generally T-shaped, with lateral extensions 58 protruding radially outward from opposing sides of central portion 54. Central portion 54 may have a rocker arm engagement end and a closed distal end. A stepped bore 60 may form a central cavity within central portion 54, and include a larger diameter at an open end 62 and a smaller diameter at a closed end 64. A shoulder 66 may be formed axially between open end 62 and closed end 64, and a drain passage 68 may be generally aligned with bore 60 and formed within closed end 64. Drain passage 68 may connect bore 60 with an open valve cover interior located above cylinder head 20 (referring to FIG. 1), and function both to drain excess fluid from bore 60 as well as provide access for a lash adjuster removal tool (not shown), the use of which will be described in more detail below. It is contemplated that a lash adjuster removal tool may not always be necessary, depending upon the type of fit between lash adjuster 52 and valve bridge 50. Additional bores 70 may be formed within valve bridge 50 at lateral extensions 58 to receive sleeve inserts 56. Bores 70 may be formed at a side of valve bridge 50 opposite stepped bore 60 (at a lower side of valve bridge 50 that is oriented toward valves 30).

An upper surface 72 of valve bridge 50 may slope downward toward a lower surface 74 of valve bridge 50, from central portion 54 to lateral extensions 58. A gravity feed groove 76 may extend from stepped bore 60 radially outward along the slope to a generally cylindrical collection reservoir 78 located at each lateral extension 58. Collection reservoir 78 may be configured to fill with oil provided from stepped bore 60 and other sources (e.g., splashed or leaked oil from cylinder head 20) via groove 76 during operation of engine 10. An axially-oriented passage 80 may connect collection reservoir 78 to the associated and oppositely oriented bore 70, thereby providing lubrication to bore 70 and sleeve insert 56 disposed therein. Passage 80 may have an internal diameter less than an internal diameter of collection reservoir 78 (e.g., the diameter of passage 80 may be about one-third to one-fourth of the diameter of collection reservoir 78). This diametrical relationship may help a supply of fluid to build within collection reservoir 78, while still providing sufficient lubrication to bore 70 and sleeve insert 56.

Lash adjuster 52 may be a sub-assembly of components that can be removably replaced as a single integral unit within valve bridge assembly 50. These components may include, among other things, an adjuster sleeve 82, a plunger 84, and a check valve assembly 86 (shown only in FIG. 3). Adjuster sleeve 82 may be hollow body that is loosely-fitted (or press-fitted in some applications) into stepped bore 60. Plunger 84 may be slidingly disposed within adjuster sleeve 82, and retained in adjuster sleeve 82 during assembly by way of a clip 88 (shown only in FIG. 3). Check valve assembly 86 may be disposed between internal ends of adjuster sleeve 82 and plunger 84. A worn lash adjuster 52 may be removed from valve bridge 50 by inserting a removal tool into drain passage 68 and pushing upward on the closed bottom of adjuster sleeve 82. It should be noted that in some embodiments and/or applications, the worn lash adjuster 52 may slide out of valve bridge 50 without the use of the removal tool. A replacement lash adjuster 52 may then be inserted back into stepped bore 60.

Adjuster sleeve 82 may be a generally hollow and cylindrical component having an open end 90 and a closed end 92. Closed end 92 may be received first within stepped bore 60, such that open end 90 of adjuster sleeve 82 is co-located at open end 62 of valve bridge 50. In the disclosed embodiment, a terminus of adjuster sleeve 82 at open end 90 may extend past a terminus of valve bridge 50 at open end 62. This configuration aids the lash adjustment procedure at assembly. The exterior of adjuster sleeve 82 may be stepped so as to generally match the stepped profile of bore 60, and the interior of adjuster sleeve 82 may mimic the exterior. Plunger 84 may be slidingly received within the larger interior diameter of adjuster sleeve 82, while check valve assembly 86 may be press-fitted into the smaller interior diameter. An annular groove 93 may be located at open end 62 to receive clip 88.

Plunger 84 may also be a generally hollow and cylindrical component having an open end 94 and a generally closed end 96. Closed end 96 of plunger 84 may be received first within open end 90 of adjuster sleeve 82, such that plunger 84 is generally inverted with respect to adjuster sleeve 82. Closed end 96 may protrude a distance out of adjuster sleeve 82 and valve bridge 50, and an external end surface thereof may function as the planar engagement surface of valve bridge assembly 48 with button 45 of rocker arm 42. A lubrication passage 98, having an enlarged entrance 100, may extend from this engagement surface through closed end 96 to an interior of plunger 84. Lubrication passage 98 may function to direct pressurized lubricant from rocker arm 42 (i.e., from button 45) into lash adjuster 52. In some embodiments, a plurality of radially-oriented recirculation passages 102 may be located between open end 94 and closed end 96, and function to direct some of the fluid from between annular side walls of adjuster sleeve 82 and plunger 84 back to the hollow interior of plunger 84. A remainder of the fluid may exit lash adjuster 52 at open end 90 of adjuster sleeve 82 and, in some embodiments, flow through grooves 76 into collection reservoirs 78. It is contemplated, however, that recirculation passages 102 may be omitted in other embodiments, if desired. Plunger 84 may include a larger diameter at its open end 94 to receive check valve assembly 86. A recess 104 may be formed within an external annular surface of plunger 84 at its closed end 96 to receive a set gauge (not shown) during lash adjustment procedures at assembly.

Check valve assembly 86 may take any conventional form configuration known in the art, and function to selectively allow fluid from within plunger 84 to enter a hydraulic chamber of adjuster sleeve 82 below a rim of plunger 84. This fluid may then become trapped in the lower hydraulic chamber of adjuster sleeve 82 and facilitate load transfer from rocker arm 42, to valves 30 (referring to FIG. 1). In the disclosed embodiment, check valve assembly 86 is a spring-biased ball-type check valve. It is contemplated, however, that other types of check valve assemblies may alternatively be utilized, as desired.

Sleeve insert 56 may embody a hollow and generally cylindrical body having an outer surface configured to be press-fitted into a corresponding bore 70 in valve bridge 50. A central bore 106 may be formed within each sleeve insert 56 and configured to slidingly receive a stem-end of a corresponding valve 30. Lubrication passage 80 may communicate collection reservoir 78 with central bore 106 via an opening 108 formed in the closed end of each sleeve insert 56. Lubrication passage 80 may be generally axially aligned with central bore 106, and diameter of lubrication passage 80 may be about one-third to one-fourth of a diameter of central bore 106. Opening 108 may be smaller than lubrication passage 80. In this configuration, a portion of the closed end of sleeve insert 56 may be visible from the upper side of valve bridge 50 (i.e., through collection reservoir 78 and lubrication passage 80). As will be described in more detail below, a sleeve removal tool (not shown) may be inserted through collection reservoir 78 and lubrication passage 80 and used to push on the closed end of and thereby dislodge sleeve insert 56. Sleeve insert 56 may have a hardness about the same as a hardness of the corresponding gas exchange valve 30, such that wear caused by relative movements therebetween is reduced.

INDUSTRIAL APPLICABILITY

The disclosed valve bridge assembly may have applicability with internal combustion engines. The valve bridge assembly may be used to lift multiple gas exchange valves (e.g., intake valves and/or exhaust valves) at the same time and by the same amount. The valve bridge assembly may have easily replaceable components, which allow it to be remanufactured and reused, resulting in lower operating costs for the engine owner. Remanufacturing of the disclosed valve bridge assembly will now be described in detail.

After a period of use, sleeve inserts 56, adjuster sleeve 82, and/or plunger 84 may have worn. If unaccounted for, the relative movement between valves 30 and rocker arm 42 could become excessive and lead to failure of valve actuation system 12. Accordingly, valve actuation system 12 may need to be periodically serviced before failure can occur. This service may include the replacement of lash adjuster 52 and sleeve inserts 56.

A worn lash adjuster 52 may be removed by inserting a tool through drain passage 68 located at lower surface 74 of valve bridge 50, and pushing upward on the closed end 92 of adjuster sleeve 82. This action may force the worn lash adjuster 52 out of the central cavity of valve bridge 50. A replacement lash adjuster 52 may then be slid (or, in some embodiments, pressed) into stepped bore 60.

Worn sleeve inserts 56 may be replaced in much the same way. Specifically, a corresponding tool may be inserted through collection reservoir and lubrication passage 80 at the lateral extensions 58 of valve bridge 50 to engage the closed end of sleeve insert 56. The tool may then be pushed downward to dislodge the worn sleeve insert 56 from bore 70. Replacement sleeve inserts 56 may then be press-fitted back into bores 70.

Because valve bridge assembly 48 may be easily remanufactured by replacing lash adjuster 52 and/or sleeve inserts 56, the operating cost of engine 10 may be low. That is, valve bridge 50 may be reused, thereby reducing a number of replacement parts and the associated required service.

It will be apparent to those skilled in the art that various modifications and variations can be made to the valve bridge assembly of the present disclosure without departing from the scope of the disclosure. Other embodiments will be apparent to those skilled in the art from consideration of the specification and practice of the embodiments disclosed herein. It is intended that the specification and examples be considered as exemplary only, with a true scope of the disclosure being indicated by the following claims.

What is claimed is:

1. A valve bridge assembly, comprising:

a valve bridge having a center portion, opposing lateral extensions, a central cavity formed within the center portion, and a bore formed within each of the opposing lateral extensions wherein the central cavity is stepped and includes a larger diameter at an open end;

the valve bridge further has a drain passage extending from a closed end of the central cavity in a direction away from the open end;

a lash adjuster disposed within the central cavity; and a sleeve insert disposed within each bore of the opposing lateral extensions, the sleeve insert being configured to receive a corresponding valve stem.

2. The valve bridge assembly of claim 1, wherein:

the center portion includes a rocker arm engagement end and an opposing distal end; and the valve bridge slopes toward the opposing distal end from the center portion to the opposing lateral extensions.

3. The valve bridge assembly of claim 2, further including a gravity feed groove disposed within the valve bridge between the center portion and each bore formed within the opposing lateral extensions.

4. The valve bridge assembly of claim 3, wherein:

the bore is formed within each of the opposing lateral extensions at a side opposite the rocker arm engagement end of the center portion; and the valve bridge further includes:

a collection reservoir disposed within each of the opposing lateral extensions at a side opposite the bore and in communication with an end of the gravity feed groove; and a lubrication passage fluidly connecting the collection reservoir with the bore.

5. The valve bridge assembly of claim 4, wherein lubrication passage has a diameter smaller than diameters of the bore and the collection reservoir.

6. The valve bridge assembly of claim 4, wherein an end of the sleeve insert is visible through the collection reservoir.

7. The valve bridge assembly of claim 1, wherein the sleeve insert is slid or press-fitted into the bore.

8. The valve bridge assembly of claim 1, wherein:

the lash adjuster includes an adjuster sleeve disposed within the central cavity; and a generally hollow plunger slidably disposed within the adjuster sleeve.

9. The valve bridge assembly of claim 8, further including a clip located at an open end of the adjuster sleeve, the clip configured to inhibit removal of the generally hollow plunger from the adjuster sleeve during assembly.

10. The valve bridge assembly of claim 8, wherein the generally hollow plunger includes a gauge recess disposed at a closed end that extends from the adjuster sleeve.

11. The valve bridge assembly of claim 8, wherein the generally hollow plunger includes radially-oriented recirculation passages located between a closed end and an open end of the generally hollow plunger.

12. The valve bridge of claim 8, wherein the lash adjuster further includes a spring- biased check valve located within the adjuster sleeve at an open end of the generally hollow plunger.

13. A method of remanufacturing a valve bridge having lateral extensions located at opposing sides of the central portion, the method comprising:

inserting a removal tool through bores located within the lateral extensions of the valve bridge to push worn sleeve inserts out of the bores;

press-fitting replacement sleeve inserts into the bores;

inserting the removal tool through a drain passage located within the central portion of the valve bridge to push a worn lash adjuster out of a central cavity; and press-fitting a replacement lash adjuster into the central cavity.

* * * * *